United States Patent [19]

Moskowitz

[11] Patent Number: 4,668,598

[45] Date of Patent: May 26, 1987

[54] MULTICOLOR IMAGES USING AN ELECTRON BEAM

[75] Inventor: Mark L. Moskowitz, Wayne, N.J.

[73] Assignee: GAF Corporation, Wayne, N.J.

[21] Appl. No.: 754,324

[22] Filed: Jul. 12, 1985

[51] Int. Cl.[4] ..... G03G 5/026; G03G 13/01

[52] U.S. Cl. ..... 430/45; 430/42; 430/46; 430/53; 430/55; 430/291; 430/942

[58] Field of Search ..... 430/47, 42, 43, 46, 430/296, 45, 291, 942, 53, 55; 346/158

[56] References Cited

U.S. PATENT DOCUMENTS

| | | | |
|---|---|---|---|
| 2,883,257 | 4/1959 | Wehe | 430/942 |
| 3,109,062 | 10/1963 | Clauer et al. | 346/158 |
| 3,418,640 | 12/1968 | Werner | 346/158 |
| 3,480,459 | 11/1969 | Asunmaa et al. | 430/291 |
| 3,653,064 | 3/1972 | Inoue et al. | 346/158 |
| 3,757,351 | 9/1973 | Simms | 346/158 |
| 3,818,493 | 6/1974 | Slack | 346/158 |
| 4,378,415 | 3/1983 | Chu | 430/46 |
| 4,510,223 | 4/1985 | Kuehnle et al. | 430/47 |
| 4,515,462 | 5/1985 | Yoneda | 430/42 |

*Primary Examiner*—Richard L. Schilling

*Attorney, Agent, or Firm*—Marilyn J. Maue; Joshua J. Ward

[57] ABSTRACT

A process for providing a direct optical readout of a pattern or collection of data in a plurality of distincitive colors on a dielectric film capable of receiving information by exposure to an electron beam imaging source, which process comprises subjecting said film to a series of separate exposures from an electron beam source, each exposure representing a portion of the overall pattern or collecton of data to be transmitted; treating said film after each exposure intended to distinguish a portion of the overall information with a toner of a distinctive color which combination of colors may be selected for maximum definition and contrast; and separately drying each of said toners on said film before re-exposing said film to said electron beam source for receipt of an additional portion of the pattern or information to be transmitted. The above procedure of exposure, toning and drying may be repeated as many times as required until all of the information of the desired pattern has been transmitted to the film and the film displays the complete information of the imaged pattern in a visual multi-colored format of high resolution, clarity and contrast. The invention also relates to the multicolored dielectric film product of the process.

2 Claims, 2 Drawing Figures

MULTICOLOR IMAGES USING AN ELECTRON BEAM

Figure 1:
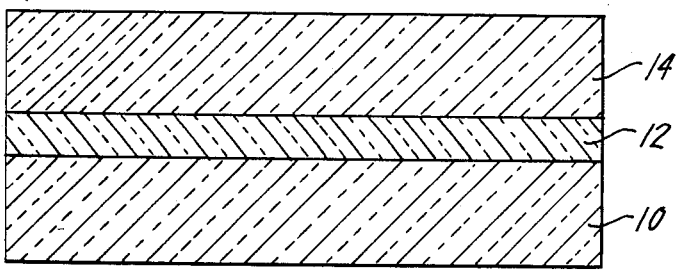

In one aspect this invention relates to a process for providing direct visual readout in a multicolored format permanently imprinted on a dielectric film which has been exposed to electron beam imaging. In another aspect, the invention relates to multicolor imaging of high contrast and definition on a dielectric film and to the product of the multicolored imaging process.

BACKGROUND OF THE INVENTION

Previously information received on film from an electron beam source was developed by subjecting the imaged film surface to chemical treatment causing a chemical change in the film composition in order to develop the image for optical readout. Such chemical development in certain cases requires a film having a photographic layer containing a silver halide emulsion which requires photodevelopment to produce a visual black and white image. Still further, such prior practices are restricted to transmittal of the entire pattern or collection of data in a single exposure and provides a format in a single hue or color, e.g. a black on white transparency.

Accordingly, it is an object of the present invention to eliminate the above disadvantages by an economical and commercially feasible process.

It is another object of the present invention to display transmitted data in contrasting colors or a variation of hues and colors to provide emphasis and distinction to certain portions of data transmitted onto a dielectric film.

Another object is to provide a multicolored image. display of an entire pattern or collection of data on a dielectric film imaged by an electron beam source, which image is permanently recorded on said film.

Still another object is to provide the multicolor image display by an economical and commercially feasible process which avoids variations in the quality of the recorded image.

These and many other objects will become apparent from the following description and disclosure.

According to this invention there is provided a process for producing a multicolored display or readout on a dielectric film imaged by a series of electron beam exposures. The process comprises imaging a dielectric film with a portion of the overall pattern or collection of data to be transmitted by an electrom beam gun, treating the exposed film surface with a colored toner, drying said toner on the surface of the film, re-exposing the film to a second image from said electron beam gun as a second or remaining portion of the overall pattern to be transmitted, treating the resulting re-exposed film surface with a toner of a color distinguished from the first colored toner, drying said second toner on the surface of the film and repeating the above operation, using a toner of distinguishing color after each successive film exposure intended to differentiate the data transmitted, for as many imagings as required to complete the desired pattern or collection of data in contrasting hues or colors.

The successive images transmitted to the film, may be superimposed over the entire film surface or may be recorded on a limited portion of the film by directing the electron beam to a restricted portion of the film.

For the specific purposes of the present invention, the film is preferably composed of at least three distinct layers, namely an electrically resistive dielectric resin layer capable of accepting a colored toner for image development, and having a film thickness of from about 1 to about 10 microns, preferably from about 2 to about 7 microns. Suitable resins include organic polymers such as polystyrene, polycarbonate, Teflon, polyethylene, acrylic resins and methacrylic resins. This electrically resistive material represents a charge accepting layer which overlays a thin conductive layer having a thickness of between about 0.4 and about 5 microns. The conductive layer limits the capacitance of the charge accepting layer and typically has a resistivity of $10^6$ ohms/sq. or less. The conductive layer is comprised of an electrically conductive metal, metal oxide, metal alloy, metal halide or carbon black, which metal and carbon black components may or may not be suspended in a dispersion medium such as gelatin, dextran, a cellulose ether or ester, etc. Suitable metals include gold, silver, platinum, copper, iron, tin, aluminum, indium, nickel, palladium, rhodium, and mixtures thereof. Metal oxides which may be suitably employed include indium-tin oxide, copper oxide, iron oxide, etc. Silver bromide and copper iodide are illustra-tive of metal halides which are suitably employed for the purposes of this invention.

Of the above, copper iodide and indium-tin oxide are preferred. The conductive layer is preferably transparent when a clear transparent support is used. However, opaque or translucent supports can tolerate thicker coatings which have reduced transparency.

Figure 2:
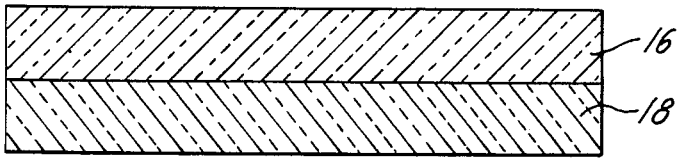

The above described charge accepting layer and the conductive layer overlay, and are supported by, a base layer which is a vacuum and dimensionally stable material having low residual volatile gases, liquids and solids. An optically clear base layer is preferred and is composed of an organic polymer in a thickness between about 0.25 and about 10 mils. Suitable materials employed for the base support layer include polyester, polyethylene terephthalate, clay-sized paper, fiberboard, metal sheet, glazed ceramics, glass, cellulose acetate, polystyrene and polycarbonates. Commercially available materials suitable as a base support are, for example, commercial polyester films such as MYLAR film supplied by duPont Corporation and HOSTAPHAN supplied by American Hoechst. In certain cases, as when a metal sheet is employed as the substrate, the separate conductive layer described above can be omitted and the film may comprise only two layers as shown in FIG. 2 of the drawings wherein the electron accepting layer 16 is directly coated on the metal sheet layer 18. The metals used for the metal sheet may be any electrically conductive metal such as the metals listed above.

As set forth above, the multilayered dielectric film is imaged with a portion of the overall pattern or collected data transmitted from an electron beam source. The electrons, under high vacuum, between about $10^{-3}$ and about $10^{31}$ ltorr, preferably between about 10−5 and about torr, bombard the surface of the film with negative charges, thus transmitting an image thereon for development into an optical display. The techniques of electron beam recording are well known, thus further amplification is not required. However, for illustrative purposes, a typical conventional electron beam recording operation suitable for the present invention may utilize an electron beam characterized by having a beam diameter of from about 1 to 25 microns, a voltage of from about 10 to 30 kv., a current flow of from about $10^{-1}$ to $10^{-6}$ amps and adapted to scan a target area at a rate such that the dwell time is from about $10^{-3}$ to $10^{31\ 5}$ seconds. Vacuum pressures commonly range from $10^{31\ 3}$ to $10^{-5}$ torr.

The image recorded on the surface of the film by the electron beam is then developed by treating the imaged film surface with a toner of a distinctive color and drying the toner on the surface of the film before returning the film for additional image exposure with a further portion or the remaining portion of the pattern to be transmitted. The film is treated with a toner of distinguishing color and dried after each image exposure until the complete pattern or collection of data is transmitted and color coded by toner.

The toners employed for developing the series of images may be selected for contrast, hue and emphasis in the representation appearing on the finished film product. These toners are electrographic, color fast, liquids or dispersions or suspensions of fine charged colored particles in a dielectric liquid. Preferred toners are those containing organic pigments. Representative of the toners which can be employed include those disclosed in British Pat. No. 1,352,067; U.S. Pat. Nos. 3,776,849 and U.S. Pat. No. 3,542,682. In general suitable conventional liquid toners or liquid toners based on toner powders are described on pages 1 and 2 of the British patent.

These liquid toners are those having a disperse pigment phase and a continuous hydrocarbon phase. The toners of the British patent are liquid electrostatographic materials having a liquid solvent system, a thermoplastic amphipathic polymer containing a moiety solvated by the system and another non-solvated moiety, and a charge director.

Examples of solvated moieties include:

A. poly (lauryl methacrylate - glycidyl methacrylate) reacted with methacrylic acid as activator.
B. poly (isodecyl methacrylate - glycidyl methacrylate) reacted with methacrylic acid as activator.
C. poly (stearyl methacrylate - glycidyl methacrylate) reacted with methacrylic acid as activator.
D. poly (lauryl methacrylate - N-[1,1,3,3-tetramethyl butyl]methacrylamide - glycidyl methacrylate) reacted with methacrylic acid as activator.

Examples of preferred non-solvated moieties include:

E. poly (vinyl acetate/N-vinyl-2-pyrrolidone)
F. poly (vinyl acetate/crotonic acid)
G. poly (vinyl acetate/methyl hydrogen maleate)
H. poly (vinyl acetate)
I. copolymer containing recurring units of methyl hydrogen maleate.

Examples of preferred combinations of solvated and non-solvated moieties in amphipathic polymers include:

J. A combined with E
K. A combined with F
L. A combined with G
M. B combined with H.

Any of the dyes or pigments disclosed on pages 11 and 12 of the patent can be used to impart the desired color and specific toners suitable in the present invention are described on pages 14 through 19.

Additionally the formulations of toners reported in U.S. Pat. No. 3,542,682 comprising an electrically insulating carrier liquid, a dispersible coloring agent, such as for example carbon black, alkali blue, nigrosine dyes etc., a soluble metal soap of a fatty acid and an alkylated polymer of a N-vinyl heterocyclic dispersant are also suitably employed herein.

Additionally the toners of U.S. Pat. No. 3,776,849 comprising a liquid carrier, a pigment and a maleic anhydride copolymer may also be used.

For the purposes of this invention any liquid electrographic toner which is responsive to an electrical image charge can be employed.

The above toners are dried on the surface of the film by conventional means, e.g. by air drying or applied heat at a temperature slightly above room temperature up to about 100° C. but below the degradation temperature of the toner and below the distortion temperature of the substrate, for a period of from about 20 seconds to about 5 minutes, preferably from about 1 to about 3 minutes. The application of toner can be performed manually by dipping or mechanically by means of a roller, spray etc. in contact with the exposed film surface and is applied in an amount sufficient to provide a clear sharp visual image without tinting the background of the film.

As a specific example, dielectric film comprising an electron accepting layer of polystyrene (2 microns) overlaying a 0.8 micron layer of indium-tin oxide deposited on a 5 mil polyethylene terephthalate base is exposed to an image relayed from an electron beam gun in a vacuum of $10^{-7}$ torr at room temperature. After imaging, the film is removed and the imaged surface treated with a blue electrographic toner. The toner may be sprayed, dipped or wiped on the surface of the exposed film. After application of the toner, the film is dried at a temperature of 60° C. under atmospheric pressure and subjected to a second image transmitted from the electron beam gun under the above vacuum and temperature conditions. After the second exposure, the film is again removed and a red toner is wiped, dipped or sprayed on the surface of the film and dried thereon. The developed film product displays a transmitted pattern wherein the first image is portrayed in a blue reproduction and the second image in a red reproduction of the pattern format.

The above example illustrates a bicolor representation of the pattern transmitted by an electron beam source. However, it is to be understood that more complex representations and displays may be produced in generally the same manner by additional imaging for further information, followed by toning each image in a distinguishing color such as for example magenta, black, green, violet, yellow, etc. and finally drying each toner on the surface of the film for a permanent multicolored finished product.

Turning now to the drawings,

FIG. 1 represents a vertical cross-sectional view of the preferred product of this invention. In FIG. 1 there is shown as the film composite, base support layer 10 over which is coated a thin conductive layer 12 bonded to electron accepting surface layer 14. Layer 14 carries the electron beam transmitted pattern in a plurality of colors (not shown).

FIG. 2 represents a vertical cross-sectional view of film having a copper sheet 18 of from 2 to mil thickness supporting an electron accepting surface layer 16 of from 2 to 10 micron thickness on which toners of distinguishing colors or hues are applied.

Having thus generally described the invention, reference is now had to the accompanying example which is not to be construed as limiting to the invention more broadly set forth in the foregoing disclosure and the accompanying claims.

EXAMPLE

The dielectric film (hereinafter DEF) used for imaging in this example consists of a indium-tin oxide (0.5 microns) coated polyester film of 4 mil thickness supplied by Sierracin Inc., and an overlaying 5 micron dielectric layer of styrenated acrylic resin supplied by Desoto Inc. as Desoto 322. A 15 KeV electron beam recorder (hereinafter EBR) operating under a vacuum of $10^{-7}$ torr was used to image the film in 60 second exposure with a grid pattern. After imaging, the exposed DEF was removed and toned by dipping the imaged film surface into a blue toner (prepared from blue concentrate #6530A, supplied by Philip A. Hunt Corporation by diluting the concentrate 3.2 ml in 800 ml Soltrol*). The toner was then air dried on the DEF and the toned film was returned to the EBR where it was exposed under the above conditions to an image of numerical values to be superimposed over the preimaged graph. The resulting DEF was again removed from the EBR and dipped with a brown toner (prepared from #6530B concentrate, supplied by Philip A. Hunt Corporation by diluting the concentrate with Soltrol as above). The brown toner was then air dried on the film to provide a bicolored film format having an imaged pattern of excellent sharpness and resolution on a transparent colorless film background. After storage of several months, the film product displayed no degradation in heat and light stability.

* a mixture of branched-chain hydrocarbons having a boiling point range of 150-250° C., supplied by Phillips Petroleum Co., Bartlesville, OK.

From the description in the above example, it will be readily apparent that more complex patterns or data imaging can be produced with additional information transmittal from the EBR and that a film format in many colors can be produced by selection of differently colored toners.

Having thus described the invention, I claim:

1. A process for direct multicolor electron beam recording of information on a dielectric film which comprises: subjecting an electrically resistive dielectric resin layer of said film to multiple exposures from an electron beam source in which each of said exposures represents various imaged portions of an overall pattern to be transmitted; successively applying to the film surface, after each exposure intended to be distinguished, in a liquid phase an electrographic toning agent of a distinguishing color so that each of the transmitted images intended to be distinguished are toned in a different color; drying said toning agent on said said dielectric resin layer and repeating exposure, toning and drying operations until all of the images required to complete the overall pattern have been recorded on the film said dielectric resin layer.

2. The process of claim 1 wherein said dielectric film comprises a base support layer on which there is coated a conductive layer, which in turn is coated with said dielectric resin layer as the electron accepting layer.

* * * * *